US006070729A

United States Patent [19]

Barnes

[11] Patent Number: 6,070,729

[45] Date of Patent: Jun. 6, 2000

[54] HAIRSTYLING ACCESSORY ORGANIZING SYSTEM

[76] Inventor: Sallie L. Barnes, 339 Norfolk St., Boston, Mass. 02124

[21] Appl. No.: 09/133,440

[22] Filed: Aug. 13, 1998

[51] Int. Cl.[7] ..... B65D 71/00; B65D 33/06

[52] U.S. Cl. ..... 206/581; 206/373; 383/25; 383/39

[58] Field of Search ..... 206/320, 349, 206/373, 581; 383/8, 25, 110, 39; 150/154, 161, 113; 190/102, 110, 111

[56] References Cited

U.S. PATENT DOCUMENTS

| | | | |
|---|---|---|---|
| 1,020,050 | 3/1912 | Padrick | 206/349 |
| 1,056,218 | 3/1913 | Sahl | 206/581 X |
| 1,942,917 | 1/1934 | D'Este et al. | 383/25 X |
| 2,575,893 | 11/1951 | Seaman | 383/25 |
| 4,513,866 | 4/1985 | Thomas | 206/373 X |
| 4,570,792 | 2/1986 | Conway | 206/349 |
| 4,718,524 | 1/1988 | Crumley | 190/110 |
| 5,054,615 | 10/1991 | Stillwagon et al. | 206/373 |
| 5,577,607 | 11/1996 | Drake et al. | 206/349 |

*Primary Examiner*—Bryon P. Gehman

[57] ABSTRACT

A new hairstyling accessory organizing system for storing and carrying hairstyling products. The inventive device includes a curling iron carrier having a generally rectangular configuration. The curling iron carrier has interior layers of cotton batting and muslin, an outside layer of a durable fabric, and an inside layer of a heat resistant material. A stove bag is dimensioned for receiving a hairstyling stove therein. The stove bag has interior layers of cotton batting and muslin, an outside layer of a durable fabric, and an inside layer of a heat resistant material. A protective holder is provided having interior layers of cotton batting and muslin, an outside layer of a durable fabric, and an inside layer of a heat resistant material. A carrying bag is dimensioned for holding the curling iron carrier, the stove bag, and the protective holder therein.

11 Claims, 2 Drawing Sheets

HAIRSTYLING ACCESSORY ORGANIZING SYSTEM

BACKGROUND OF THE INVENTION

1. Field of the Invention

The present invention relates to carriers and more particularly pertains to a new hairstyling accessory organizing system for storing and carrying hairstyling products.

2. Description of the Prior Art

The use of carriers is known in the prior art. More specifically, carriers heretofore devised and utilized are known to consist basically of familiar, expected and obvious structural configurations, notwithstanding the myriad of designs encompassed by the crowded prior art which have been developed for the fulfillment of countless objectives and requirements.

Known prior art carriers include U.S. Pat. No. 4,210,244 to Westrick; U.S. Pat. No. 4,570,792 to Conway; U.S. Pat. No. 1,094,009 to Parkhurst; U.S. Pat. No. 5,054,615 to Stillwagon et al.; U.S. Pat. No. 3,180,485 to Nevitt; Patent No. EP 0 047 539 A1 to Cipelli; and Patent No. 0 664 259 A1 to Futerman et al.

While these devices fulfill their respective, particular objectives and requirements, the aforementioned patents do not disclose a new hairstyling accessory organizing system. The inventive device includes a curling iron carrier having a generally rectangular configuration. The curling iron carrier has interior layers of cotton batting and muslin, an outside layer of a durable fabric, and an inside layer of a heat resistant material. A stove bag is dimensioned for receiving a hairstyling stove therein. The stove bag has interior layers of cotton batting and muslin, an outside layer of a durable fabric, and an inside layer of a heat resistant material. A protective holder is provided having interior layers of cotton batting and muslin, an outside layer of a durable fabric, and an inside layer of a heat resistant material. A carrying bag is dimensioned for holding the curling iron carrier, the stove bag, and the protective holder therein.

In these respects, the hairstyling accessory organizing system according to the present invention substantially departs from the conventional concepts and designs of the prior art, and in so doing provides an apparatus primarily developed for the purpose of storing and carrying hairstyling products.

SUMMARY OF THE INVENTION

In view of the foregoing disadvantages inherent in the known types of carriers now present in the prior art, the present invention provides a new hairstyling accessory organizing system construction wherein the same can be utilized for storing and carrying hairstyling products.

The general purpose of the present invention, which will be described subsequently in greater detail, is to provide a new hairstyling accessory organizing system apparatus and method which has many of the advantages of the carriers mentioned heretofore and many novel features that result in a new hairstyling accessory organizing system which is not anticipated, rendered obvious, suggested, or even implied by any of the prior art carriers, either alone or in any combination thereof.

To attain this, the present invention generally comprises a curling iron carrier having a generally rectangular configuration. The curling iron carrier has interior layers of cotton batting and muslin, an outside layer of a durable fabric, and an inside layer of a heat resistant material. The inside layer has a plurality of pockets formed therein. Each of the pockets is dimensioned for receiving a curling iron therein. The curling iron carrier has a U-shaped flexible handle extending between opposing long edges thereof. Opposing short edges of the curling iron carrier each have a strap extending outwardly thereof. One strap has a D-ring disposed on a free end thereof. A pair of hook and loop patches are disposed inwardly of the opposing short edges. One pair of hook and loop patches are disposed on the inside layer and one pair of hook and loop patches are disposed on the outside layer. A stove bag is dimensioned for receiving a hairstyling stove therein. The stove bag has interior layers of cotton batting and muslin, an outside layer of a durable fabric, and an inside layer of a heat resistant material. The stove bag has an elastic band disposed downwardly of an open upper end thereof. The open upper end has a handle secured thereto. A protective holder is provided having interior layers of cotton batting and muslin, an outside layer of a durable fabric, and an inside layer of a heat resistant material. The protective holder has a handle extending outwardly from an edge thereof. A carrying bag is dimensioned for holding the curling iron carrier, the stove bag, and the protective holder therein. The carrying bag has a strap secured to an open upper end thereof. The carrying bag includes a pouch formed on a side thereof. The pouch has a hook and loop closure associated therewith. The carrying bag has an outside layer of a durable fabric and an interior cotton lining.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hairstyling accessory organizing system apparatus and method which has many of the advantages of the carriers mentioned heretofore and many novel features that result in a new hairstyling accessory organizing system which is not anticipated, rendered obvious, suggested, or even implied by any of the prior art carriers, either alone or in any combination thereof.

It is another object of the present invention to provide a new hairstyling accessory organizing system which may be easily and efficiently manufactured and marketed.

It is a further object of the present invention to provide a new hairstyling accessory organizing system which is of a durable and reliable construction.

An even further object of the present invention is to provide a new hairstyling accessory organizing system which is susceptible of a low cost of manufacture with regard to both materials and labor, and which accordingly is then susceptible of low prices of sale to the consuming public, thereby making such hairstyling accessory organizing system economically available to the buying public.

Still yet another object of the present invention is to provide a new hairstyling accessory organizing system which provides in the apparatuses and methods of the prior art some of the advantages thereof, while simultaneously overcoming some of the disadvantages normally associated therewith.

Still another object of the present invention is to provide a new hairstyling accessory organizing system for storing and carrying hairstyling products.

Yet another object of the present invention is to provide a new hairstyling accessory organizing system which includes a curling iron carrier having a generally rectangular configuration. The curling iron carrier has interior layers of cotton batting and muslin, an outside layer of a durable fabric, and an inside layer of a heat resistant material. A stove bag is dimensioned for receiving a hairstyling stove therein. The stove bag has interior layers of cotton batting and muslin, an outside layer of a durable fabric, and an inside layer of a heat resistant material. A protective holder is provided having interior layers of cotton batting and muslin, an outside layer of a durable fabric, and an inside layer of a heat resistant material. A carrying bag is dimensioned for holding the curling iron carrier, the stove bag, and the protective holder therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
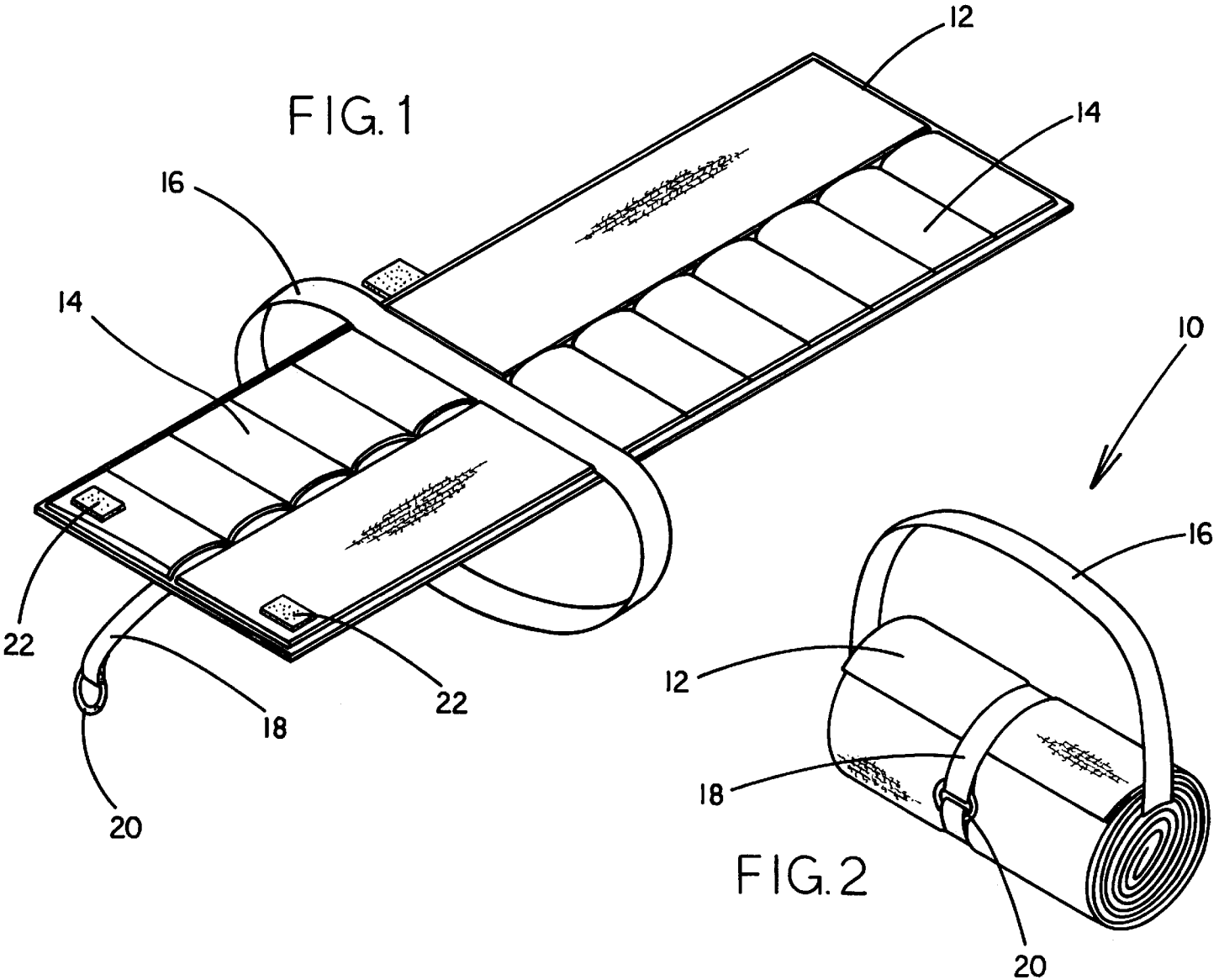
FIG. 1 is a perspective view of a curling iron carrier of a new hairstyling accessory organizing system according to the present invention illustrated in an unrolled orientation.
FIG. 2 is a perspective view of the curling iron carrier of the present invention illustrated in a rolled orientation.
Figure 3:
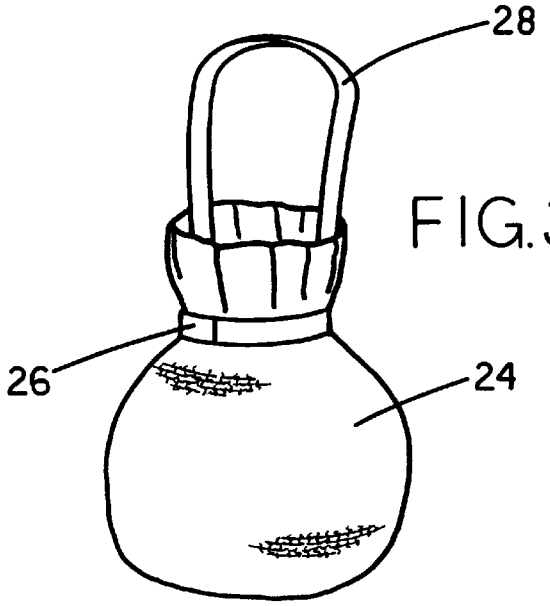
FIG. 3 is a perspective view of a stove bag of the present invention.
Figure 4:
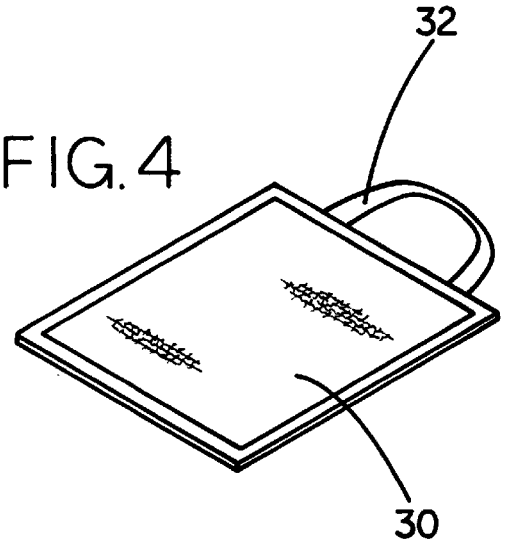
FIG. 4 is a perspective view of a protective holder of the present invention.
Figure 5:
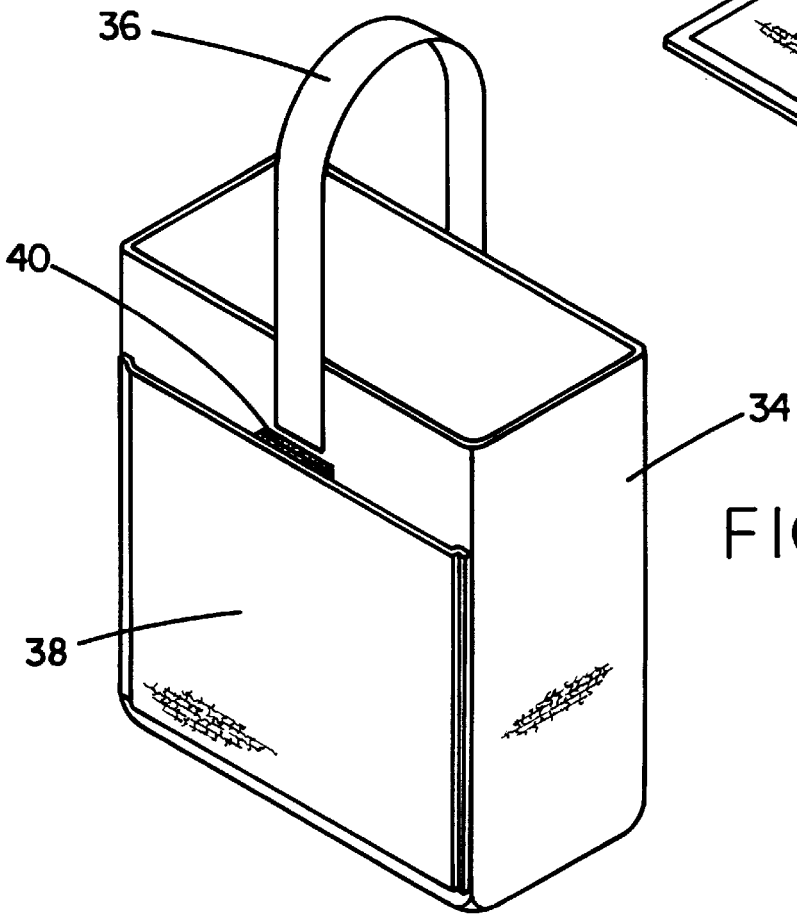
FIG. 5 is a perspective view of a carrying bag of the present invention.

With reference now to the drawings, and in particular to FIGS. 1 through 5 thereof, a new hairstyling accessory organizing system embodying the principles and concepts of the present invention and generally designated by the reference numeral 10 will be described.

As best illustrated in FIGS. 1 through 5, the hairstyling accessory organizing system 10 comprises a curling iron carrier 12 having a generally rectangular configuration. The curling iron carrier 12 has interior layers of cotton batting and muslin, an outside layer of a durable fabric, and an inside layer of a heat resistant material. The inside layer has a plurality of pockets 14 formed therein. Each of the pockets 14 is dimensioned for receiving a curling iron therein. FIG. 1 illustrates two sets of pockets 14 with one set of pockets 14 disposed inwardly of one long side edge and the other set disposed inwardly of the other opposed long side edge. The curling iron carrier 12 has a U-shaped flexible handle 16 extending between opposing long edges thereof. Opposing short edges of the curling iron carrier 12 each have a strap 18 extending outwardly thereof. One strap 18 has a D-ring 20 disposed on a free end thereof. A pair of hook and loop patches 22 are disposed inwardly of the opposing short edges. One pair of hook and loop patches 22 are disposed on the inside layer and one pair of hook and loop patches 22 are disposed on the outside layer. The hook and loop patches 22 on the inside layer will couple with the hook and loop patches 22 on the outside layer when the curling iron carrier 12 is in a rolled orientation. Note FIG. 2. Once rolled, the opposed straps 18 can be coupled together via the D-ring 20 to prevent the inadvertent unrolling of the curling iron carrier 12. The composition of the curling iron carrier 12 allows for hot irons to transported in a safe manner. The handle 16 allows for the easy transport of the curling iron carrier 12.

A stove bag 24 is dimensioned for receiving a hairstyling stove therein. The stove bag 24 has interior layers of cotton batting and muslin, an outside layer of a durable fabric, and an inside layer of a heat resistant material. The stove bag 24 has an elastic band 26 disposed downwardly of an open upper end thereof. The open upper end has a handle 28 secured thereto. The elastic band 26 would allow the open upper end to expand to receive the stove therein.

A protective holder 30 is provided having interior layers of cotton batting and muslin, an outside layer of a durable fabric, and an inside layer of a heat resistant material. The protective holder 30 has a handle 32 extending outwardly from an edge thereof. The protective holder 30 is utilized for handling the hot irons and the stove, when hot.

A carrying bag 34 is dimensioned for holding the curling iron carrier 12, the stove bag 24, and the protective holder 30 therein. The carrying bag 34 has a strap 36 secured to an open upper end thereof. The carrying bag 34 includes a pouch 38 formed on a side thereof. The pouch 38 has a hook and loop closure 40 associated therewith. The carrying bag 34 has an outside layer of a durable fabric and an interior cotton lining. The carrying bag 34 is large enough to hold other styling tools.

In use, the present invention is an organizer for professional hairstylists that would be used to store and carry products required in performing their services. With the present invention, hairstyling products would be easily accessible when needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hairstyling accessory organizing system for storing and carrying hairstyling products comprising, in combination:

a curling iron carrier having a generally rectangular configuration defining an outside and an inside the curling iron carrier having interior layers of cotton batting and muslin, an outside layer of a durable fabric lining said outside of said curling iron carrier, and an inside layer of a heat resistant material lining said inside of the curling iron carrier, the inside layer having a plurality of pockets formed therein, said pockets being arranged into two aligned groups, each group having a first pocket positioned adjacent a diagonally opposite corner of said inside from the other of said first pockets, each of said pockets extending inwardly from a longitudinal side of said inside to a line substantially longitudinally bisecting said inside such that interior edges of said pockets on opposite longitudinal sides of said carrier are prevented from overlapping each other when said carrier is rolled along the longitudinal axis for storage, each group having a distal pocket positioned at an opposite end of the respective group from the first pocket, each distal pocket being positioned diagonally adjacent to the other distal pocket, each of the pockets being dimensioned for receiving a curling iron therein, the curling iron carrier having a U-shaped flexible handle extending between opposing long edges thereof, opposing short edges of the curling iron carrier each having a strap extending outwardly thereof, one strap having a D-ring disposed on a free end thereof, a pair of hook and loop patches disposed inwardly of the opposing short edges, one pair of hook and loop patches disposed on the inside layer and one pair of hook and loop patches disposed on the outside layer;

a stove bag dimensioned for receiving a hairstyling stove therein, the stove bag having interior layers of cotton batting and muslin, an outside layer of a durable fabric, and an inside layer of a heat resistant material, the stove bag having an elastic band disposed downwardly of an open upper end thereof, the open upper end having a handle secured thereto;

a protective holder having interior layers of cotton batting and muslin, an outside layer of a durable fabric, and an inside layer of a heat resistant material, the protective holder having a handle extending outwardly from an edge thereof; and a carrying bag dimensioned for holding the curling iron carrier, the stove bag, and the protective holder therein, the carrying bag having a strap secured to an open upper end thereof, the carrying bag including a pouch formed on a side thereof, the pouch having a hook and loop closure associated therewith, the carrying bag having an outside layer of a durable fabric and an interior cotton lining.

2. A hairstyling accessory organizing system for storing and carrying hairstyling products comprising, in combination:

a curling iron carrier having a generally rectangular configuration defining an outside and an inside, the curling iron carrier having interior layers of cotton batting and muslin, an outside layer of a durable fabric lining said outside of said curling iron carrier, and an inside layer of a heat resistant material lining said inside of the curling iron carrier, the inside layer having a plurality of pockets formed therein, said pockets being arranged into two aligned groups, each group having a first pocket positioned adjacent a diagonally opposite corner of said inside from the other of said first pockets, each of said pockets extending inwardly from a longitudinal side of said inside to a line substantially longitudinally bisecting said inside such that interior edges of said pockets on opposite longitudinal sides of said carrier are prevented from overlapping each other when said carrier is rolled along the longitudinal axis for storage, each group having a distal pocket positioned at an opposite end of the respective group from the first pocket, each distal pocket being positioned diagonally adjacent to the other distal pocket, each of the pockets being dimensioned for receiving a curling iron therein;

a stove bag dimensioned for receiving a hairstyling stove therein, the stove bag having interior layers of cotton batting and muslin, an outside layer of a durable fabric, and an inside layer of a heat resistant material;

a protective holder having interior layers of cotton batting and muslin, an outside layer of a durable fabric, and an inside layer of a heat resistant material; and a carrying bag dimensioned for holding the curling iron carrier, the stove bag, and the protective holder therein.

3. The hairstyling accessory organizing system as set forth in claim 2 wherein the curling iron carrier has a U-shaped flexible handle extending between opposing long edges thereof.

4. The hairstyling accessory organizing system as set forth in claim 2 wherein opposing short edges of the curling iron carrier each have a strap extending outwardly thereof, one said strap having a D-ring disposed on a free end thereof.

5. The hairstyling accessory organizing system as set forth in claim 2 wherein a pair of hook and loop patches are disposed inwardly of opposing short edges of the curling iron carrier, one pair of hook and loop patches disposed on the inside layer of the curling iron carrier and one pair of hook and loop patches disposed on the outside layer of the curling iron carrier.

6. The hairstyling accessory organizing system as set forth in claim 2 wherein the stove bag has an elastic band disposed downwardly of an open upper end thereof, the open upper end having a handle secured thereto.

7. The hairstyling accessory organizing system as set forth in claim 2 wherein the protective holder has a handle extending outwardly from an edge thereof.

8. The hairstyling accessory organizing system as set forth in claim 2 wherein the carrying bag has a strap secured to an open upper end thereof.

9. The hairstyling accessory organizing system as set forth in claim 2 wherein the carrying bag includes a pouch formed on a side thereof.

10. The hairstyling accessory organizing system as set forth in claim 9 wherein the pouch has a hook and loop closure associated therewith.

11. The hairstyling accessory organizing system as set forth in claim 2 wherein the carrying bag has an outside layer of a durable fabric and an interior cotton lining.

* * * * *